US006354925B1

(12) United States Patent
Chou et al.

(10) Patent No.: US 6,354,925 B1
(45) Date of Patent: Mar. 12, 2002

(54) COMPOSITE POLISHING PAD

(75) Inventors: Liang-Kuei Chou, Hsinchu Hsien; Chi-Hone Li, Taipei Hsien; Chii-Yeh Huang, Taipei, all of (TW)

(73) Assignee: Winbond Electronics Corp., Hsinchu (TW)

( * ) Notice: Subject to any disclaimer, the term of this patent is extended or adjusted under 35 U.S.C. 154(b) by 0 days.

(21) Appl. No.: 09/393,982

(22) Filed: Sep. 10, 1999

(30) Foreign Application Priority Data

Aug. 21, 1999 (TW) ..... 88114312

(51) Int. Cl.[7] ..... B24B 7/00

(52) U.S. Cl. ..... 451/259; 451/285; 451/533; 451/530

(58) Field of Search ..... 451/72, 530, 533, 451/534, 538, 550, 259, 921, 285

(56) References Cited

U.S. PATENT DOCUMENTS 5,170,595 A * 12/1992 Wiland ..... 51/394
5,310,455 A * 5/1994 Pasch et al. ..... 156/636
5,403,228 A * 4/1995 Pasch ..... 451/259
5,605,499 A * 2/1997 Sugiyama et al. ..... 451/443
5,725,417 A * 3/1998 Robinson ..... 451/56
5,899,745 A * 5/1999 Kim et al. ..... 438/692
5,975,994 A * 11/1999 Sandhu et al. ..... 451/56

* cited by examiner

*Primary Examiner*—Timothy V. Eley
*Assistant Examiner*—Dung Van Nguyen
(74) *Attorney, Agent, or Firm*—Jiawei Huang; J.C. Patents

(57) ABSTRACT

A composite polishing pad. A lower polishing pad is concentrically disposed on a turning table. The lower polishing pad has a same radius of the turning pad. A handler is installed at a periphery of the lower polishing pad to advantage a renewal process. An upper polishing pad is disposed on the lower polishing pad, again, concentrically to the turning table. The upper polishing pad has a radius between a covering range of polishing dresser (conditioner) and a covering range of a top ring. Therefore, while initiating, the projecting portions are not formed on the composite polishing pad, so that the manually notching step is skipped.

13 Claims, 5 Drawing Sheets

COMPOSITE POLISHING PAD

CROSS-REFERENCE TO RELATED APPLICATION

This application claims the priority benefit of Taiwan application serial no. 88114312, filed Aug. 21, 1999, the full disclosure of which is incorporated herein by reference.

BACKGROUND OF THE INVENTION

1. Field of the Invention

The invention relates in general to a chemical mechanical polisher. More particularly, this invention relates to a composite polishing pad used in a chemical mechanical polisher.

2. Description of the Related Art

Surface planarization is a very important technique that directly affects the precision of a photolithography process. Only when the surface is planarized, a scattering effect of the exposure light can be avoided to transfer a pattern with fidelity.

Currently, two planarization techniques including spin-on-glass (SOG) and chemical mechanical polishing (CMP) have been widely used in industry. As the semiconductor fabrication technique has approached the deep sub-micron regime, the required level of planarity can not be achieved using the technique of spin-on-glass. The only technique to provide the required level of planarity in a very large scale integration (VLSI) or ultra large scale integration (ULSI) is chemical mechanical polishing. In the chemical mechanical polishing process, a polishing theory similar to that used for a grinder is used with the aid of a chemical reagent. The uneven surface profile is thus smoothed. With an appropriate control of the polishing parameters, about 90% of planarity can be achieved using chemical mechanical polishing.

FIG. 1A and FIG. 1B are a top view and a cross sectional view of a conventional chemical mechanical polisher. The chemical mechanical polisher comprises a turning table 10, a polishing pad 13 on the turning pad, a top ring 11 for retaining a wafer 12 for polish, a transportation tube 14 for slurry 19 supplying and a pump 15 for providing the slurry 19.

While performing a chemical mechanical polishing step, the turning pad 10 and the top ring 11 are rotating along a certain direction, for example, the direction indicated by the arrow 18*a* and 18*b*. The slurry is continuously supplied onto the polishing pad 13 for polishing. Being held by the top ring 11, the wafer 12 has a surface to be polished in contact with the polishing pad 13, the uneven parts of the surface to be polishing is thus planarized with the aid of the slurry 19.

The parameters to affect the effect of planarization for a chemical mechanical polishing step includes the structure and material of the polishing pad, the material of the slurry and the rotating speed of the turning table and the top ring. A structure of a conventional polishing pad is shown as FIG. 2A. The turning table and the polishing pad are contacted with each other. The polishing pad 25 includes a lower polishing pad 24 in contact with a turning table 22 and an upper polishing pad 26 on the lower polishing pad 24. The lower and the upper polishing pads 24 and 26 are in a circular shape with a same size that is slightly larger than the size of the turning table 22.

FIG. 2A to FIG. 2C shows an initiating step for a polishing pad to illustrate how the structure of the polishing pad affects the polishing. An unworked polishing pad 25 is shown as FIG. 2A, while the upper polishing pad 26 has a surface with a poor roughness that cannot perform the polishing step. Thus, as shown in FIG. 2B, a dresser (conditioner) 28 is used to initiate the upper polishing pad 26 to effectively achieve the polishing effect with the aid of the slurry. In addition, after the polishing pad has been used for once, the polishing pad is inevitably consumed to fail to meet the polishing requirement. The initiating step is required to perform on the polishing pad again.

The polishing pad 25 is typically designed with a larger radius than that of the turning table 22, so that the polishing pad 25 can be renewed easily. As a consequence, the initiating effect is only resulted on the part supported by the turning table 22. As shown in the figure, the part experienced with a direct pressure of the dresser 28 is dished, while the rim 30 of the polishing pad 25 raises relatively. A hollow part 29 is thus formed as shown in FIG. 2C. While performing polishing on the initiated polishing pad 25, the used slurry or polishing particle thus cannot be discharged to seriously affect the polishing effect.

To resolve the problem for discharging the used slurry or polishing particles, the projecting rim 30 is cut away, typically by notching 32 at a point from the hollow part 29 of the polishing pad 25. While cutting the projecting rim 30, the polisher has to be opened. Meanwhile, a great possibility of contamination is caused, and numbers of particles or defects on product are thus increased to decrease the yield of product. Moreover, the usage of the polishing pad is so frequent and the renewal rate is high. If a cutting step is required while initiating each polishing pad, the consuming time is more than half an hour. Therefore, a long time and a great effort of labor are consumed. Moreover, the operator for performing the initiating step has to be well trained. If the cutting skill is poor, problems such as unintentionally hooking the wafer retained by the top ring or wafer dropped from the top ring occur while the polishing pad is cut into too small a piece. Or the underlying material is contaminated if a notch is cut too deep.

SUMMARY OF THE INVENTION

The invention provides a composite polishing pad used in a chemical mechanical polisher. The composite polishing pad comprises an upper polishing pad and a lower polishing pad which is concentrically disposed on a turning table. The lower polishing pad has a diameter the same as that of the turning pad. Therefore, the lower polishing pad and the turning pad are overlapped with each other thoroughly. The lower polishing pad has a handler on a periphery thereof for a convenient renewal. The upper polishing pad is disposed on the lower polishing pad concentrically. The upper polishing pad has a diameter between a covering range of a dress for initiating the composite polishing pad and a covering range of a top ring for retaining a wafer to be polished.

By designing the upper polishing pad with a diameter between the dresser of the composite polishing pad and the covering range of the top ring, the formation of the projecting portion in the conventional structure is eliminated. The manually cutting or notching step is skipped. The problems the induced thereby can thus be resolved. Moreover, the design of the handler enables an operator to renew the polishing pad without opening the polisher. Thus, the contamination can be further eliminated, and the time consuming for the renewal can be shortened.

The structure of the composite polishing pad can be modified into a lamination of a lower polishing pad slight larger than the turning table and an upper polishing pad with having size between the covering ranges of the dresser and the top ring. In this manner, the composite polishing pad can be easily renewed without the formation of a handler.

Both the foregoing general description and the following detailed description are exemplary and explanatory only and are not restrictive of the invention, as claimed.

DESCRIPTION OF THE PREFERRED EMBODIMENTS

Figure 1A:
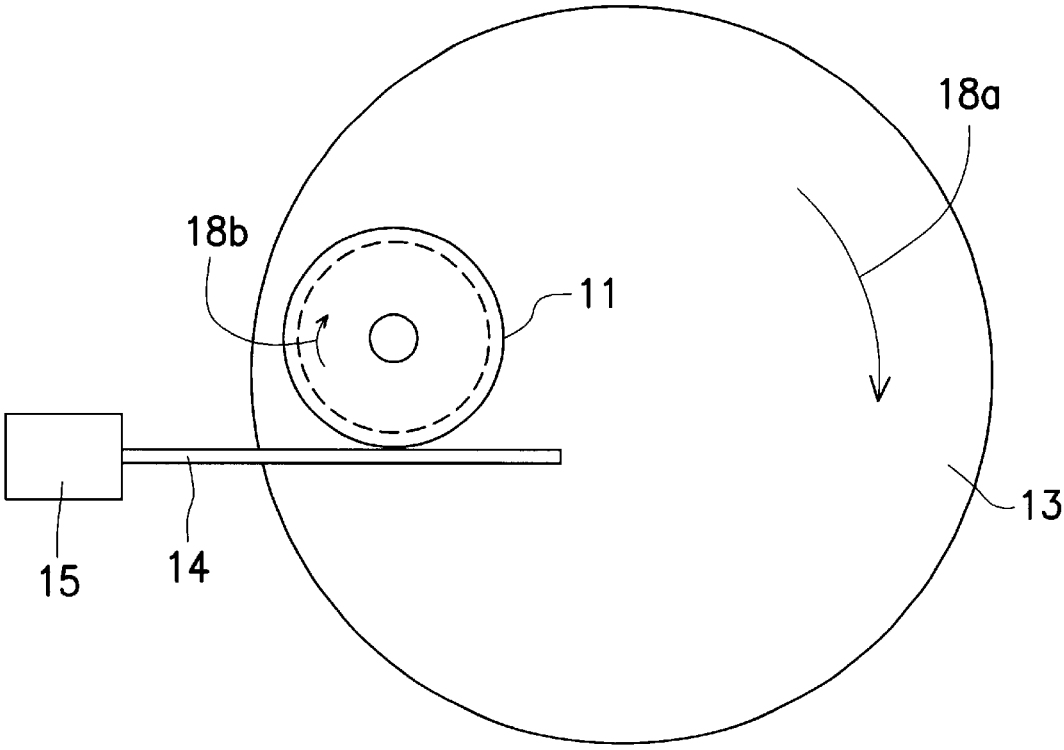
FIG. 1A (PRIOR ART)
FIG. 1A shows a top view of a conventional chemical mechanical polisher.
Figure 1B:
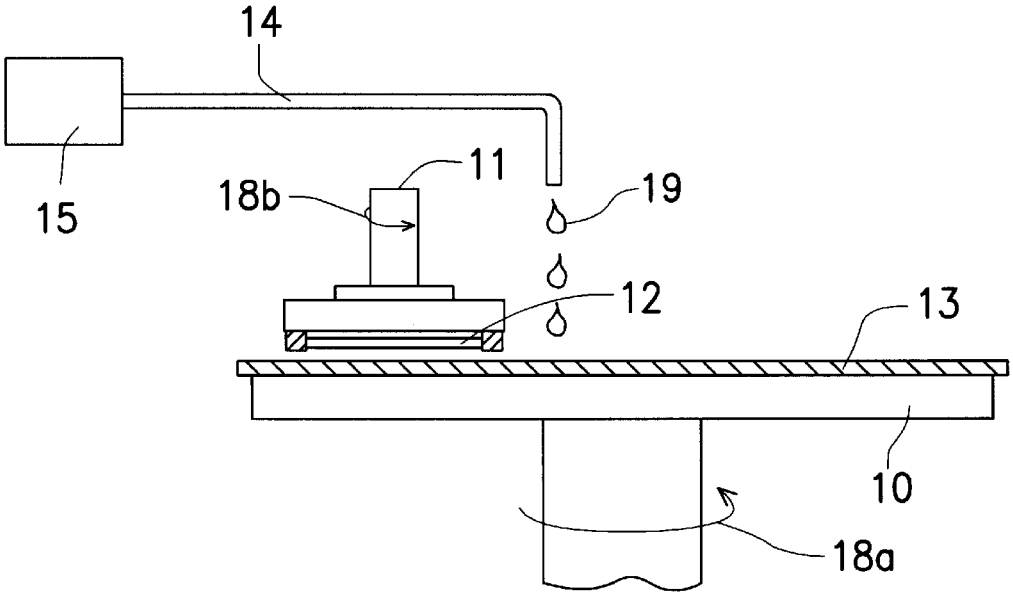
FIG. 1B (PRIOR ART)
FIG. 1B shows a cross sectional view of the conventional chemical mechanical polisher.
Figure 2A:
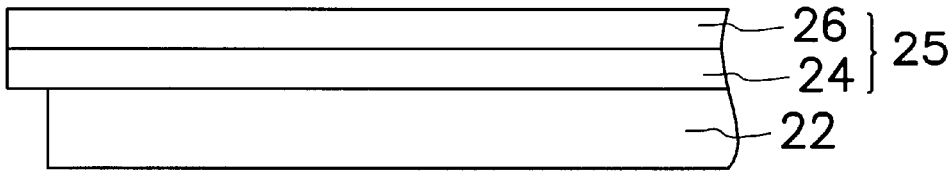
FIG. 2A (PRIOR ART)
FIG. 2A to FIG. 2C illustrating the process of initiating a conventional composite polishing pad.
Figure 2B:
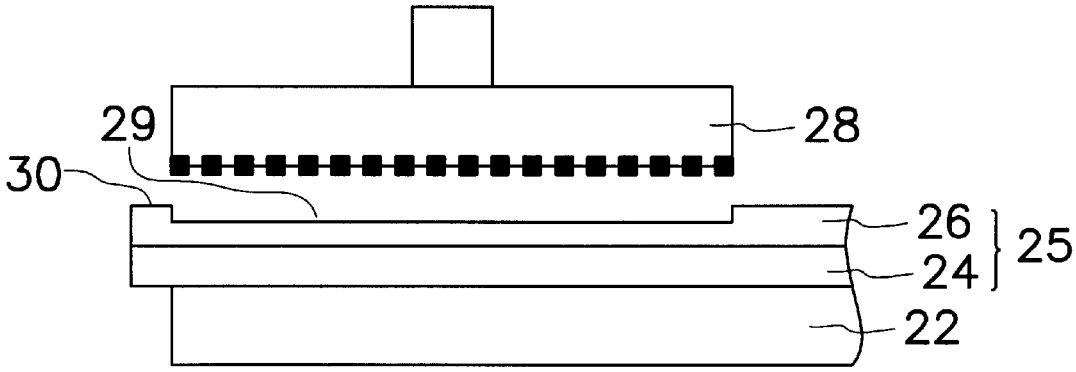
FIG. 2B (PRIOR ART)
Figure 2C:
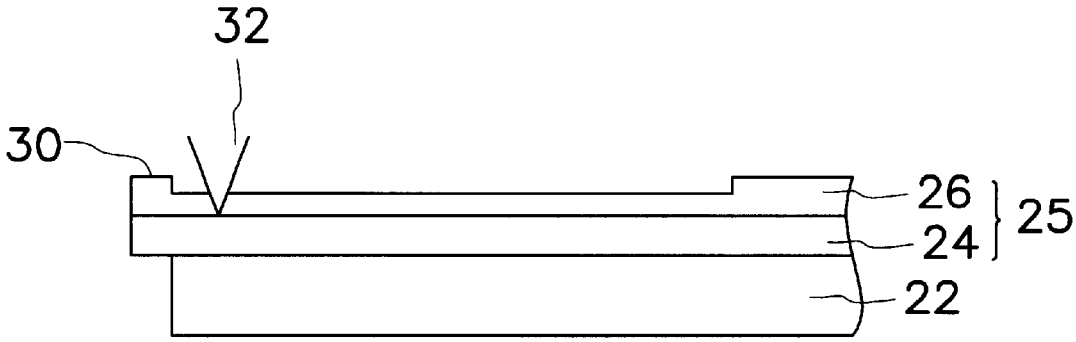
FIG. 2C (PRIOR ART)
Figure 3:
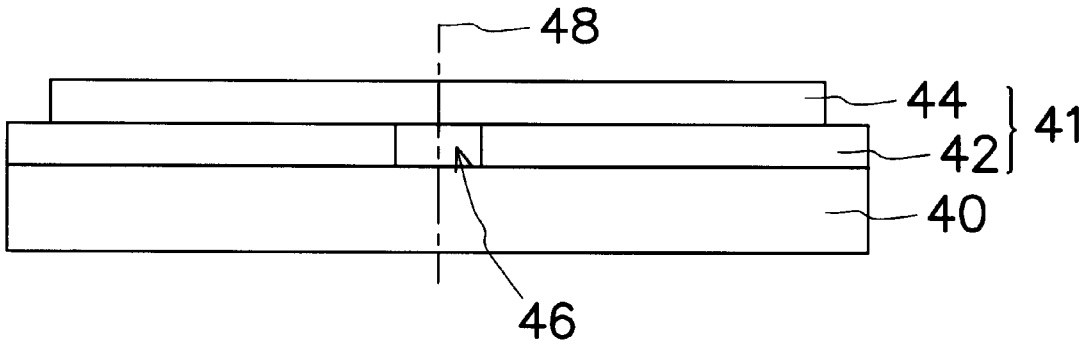
FIG. 3 shows a cross sectional view of an arrangement of turning table and a composite polishing pad in an embodiment according to the invention.
Figure 4:
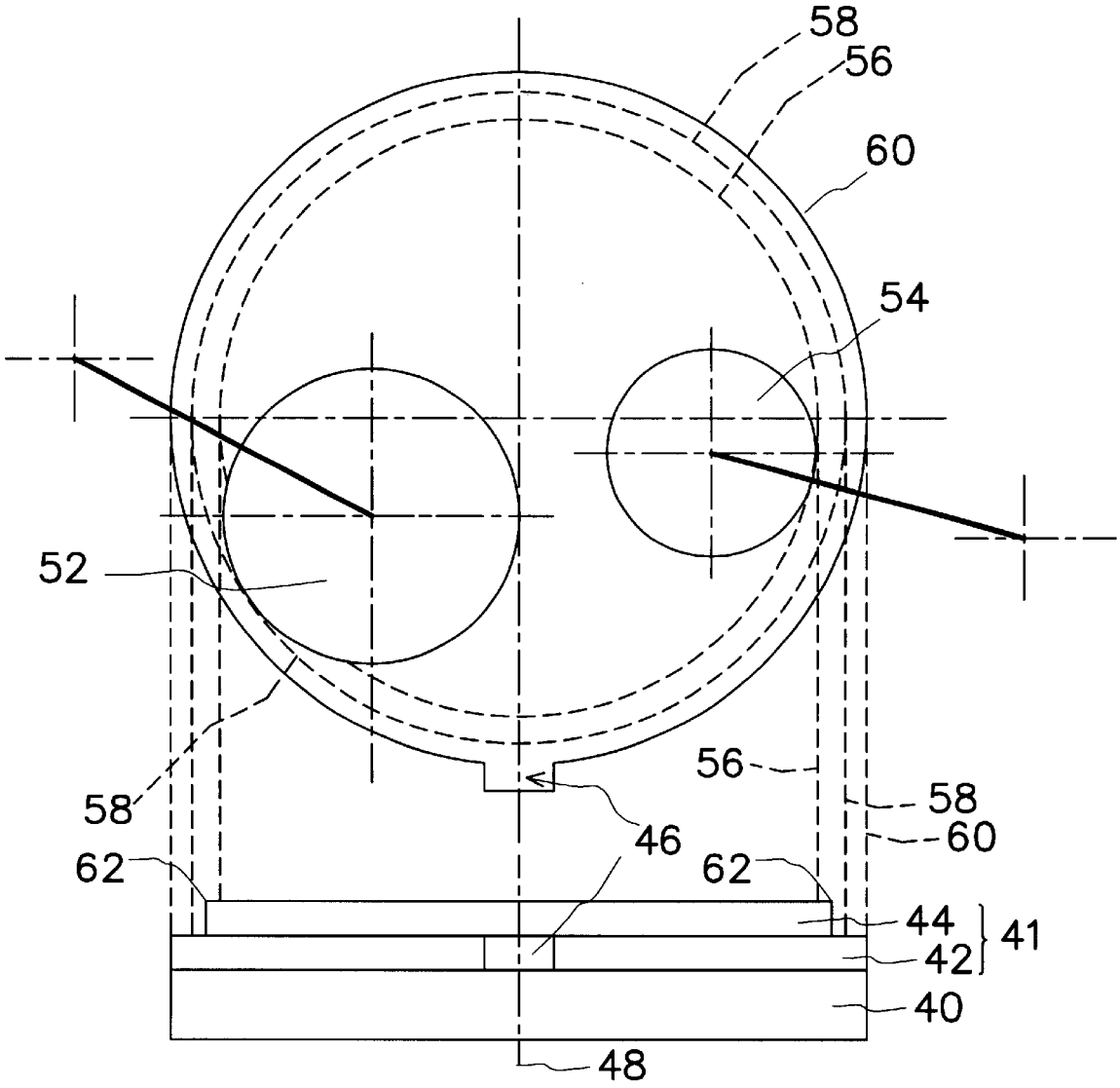
FIG. 4 shows the top view of the turning table and the composite polishing pad corresponding to the arrangement as shown in FIG. 3.

FIG. 3 shows a cross sectional view of an embodiment of a composite polishing pad, while in FIG. 4, the composite polishing pad 41 is formed on a turning table 40 and a top view is shown. The composite polishing pad 41 comprises a lower polishing pad 42 and an upper polishing pad 44 made of polymer material. The lower polishing pad 42 is concentrically superposed on the turning table 40, where a center line 48 indicates the concentric axis. The lower polishing pad 42 and the turning table 40 are designed with an identical circular shape with an identical diameter. A handler 46 is designed at a periphery of the lower polishing pad 42 to advantage the changeover or renewal. The upper polishing pad 44 is adhered onto the lower polishing pad 42 with a glue. The upper polishing pad 44 is also concentrically with the turning table 40 with a diameter smaller than that of the turning table 40 or the lower polishing pad 42.

To describe the dimension of the upper polishing pad 44 in more details, FIG. 4 is drawn to illustrate a relationship between the cross sectional view and the top view thereof. Before being used, the composite polishing pad 41 is initiated by a dresser 52. In FIG. 4, both the dresser 52 and a top ring 54 for holding a wafer to be polished are shown. The covering range of the top ring 54 is drawn as the inner dash-line circle 56, while the covering range of the dresser 52 is drawn as the outer dash-line circle 58. In addition, the solid-line circle 60 indicates the area of the lower polishing pad 42 and the turning table 40.

As shown in FIG. 4, the covering range of the dresser 52 is larger than the covering range of the top ring 54. In this manner, the range for polishing the wafer can be controlled within a range for initiating the composite polishing pad 41. Mapping the covering range 58 of the dresser 52 and the covering range 56 of the top ring 54 with the cross sectional view in the bottom, a rim 62 the upper polishing pad 44 is ranged between the covering ranges 56 and 58. That is, the radius of the upper polishing pad 44 is smaller than the covering range 58 of the dresser 52 and larger than the covering range 56 of the top ring 54. Since the upper polishing pad 44 has a radius smaller than the covering range 58 of the dresser 52, the upper polishing pad 44 can be precisely controlled within the covering range 58 without forming a projecting or raising part. Therefore, the cutting step in the conventional initiating step is not required. With a radius larger than radius of the top ring 54, the upper polishing pad 44 can be controlled within an effective polishing range for performing polishing.

Figure 5:
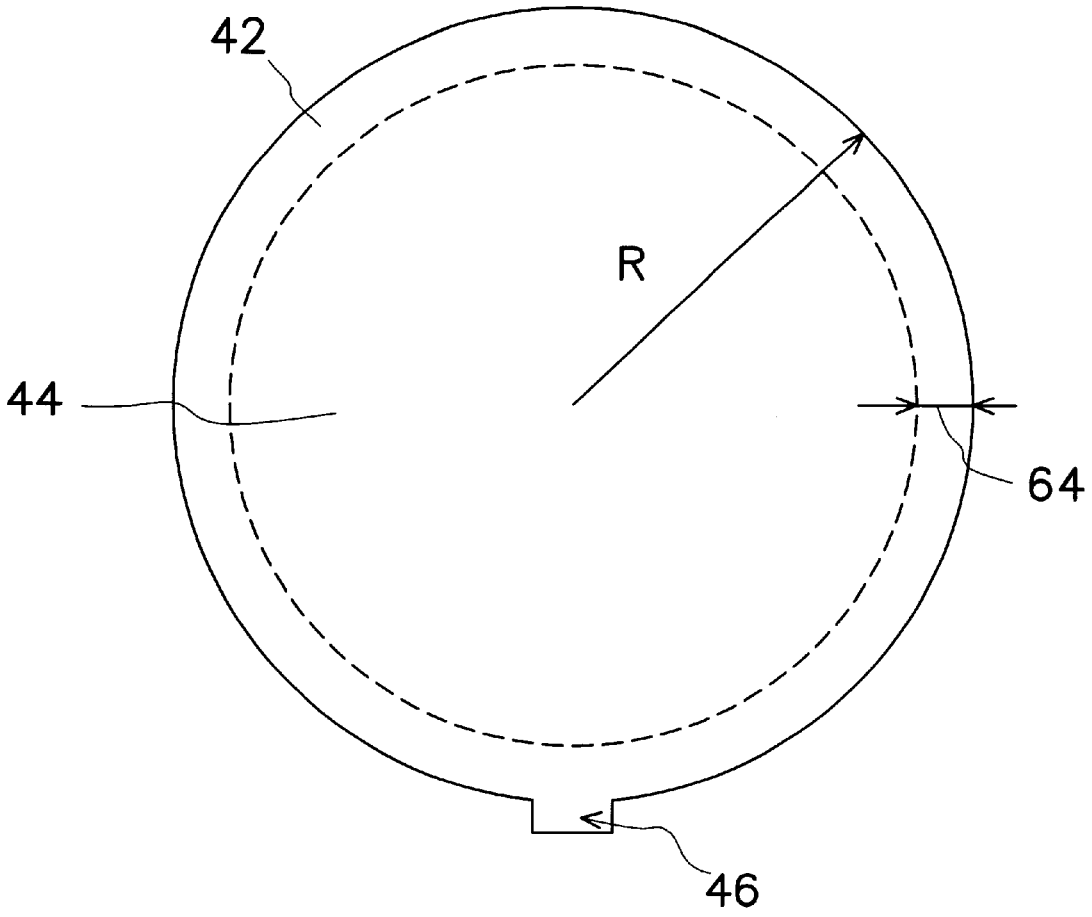
FIG. 5 shows a top view of the composite polishing pad which can be applied in a chemical mechanical polisher manufactured by EBARA.

FIG. 5 shows a specification of a polishing pad fabricated by EBARRA. The lower polishing pad 42 has a radius R of 300 mm, while the radius difference between the lower polishing pad 42 and the upper polishing pad 44 is about 5 mm to about 14.5 mm. This radius difference reflects a difference in covering ranges of the dresser and the top ring.

Figure 6:
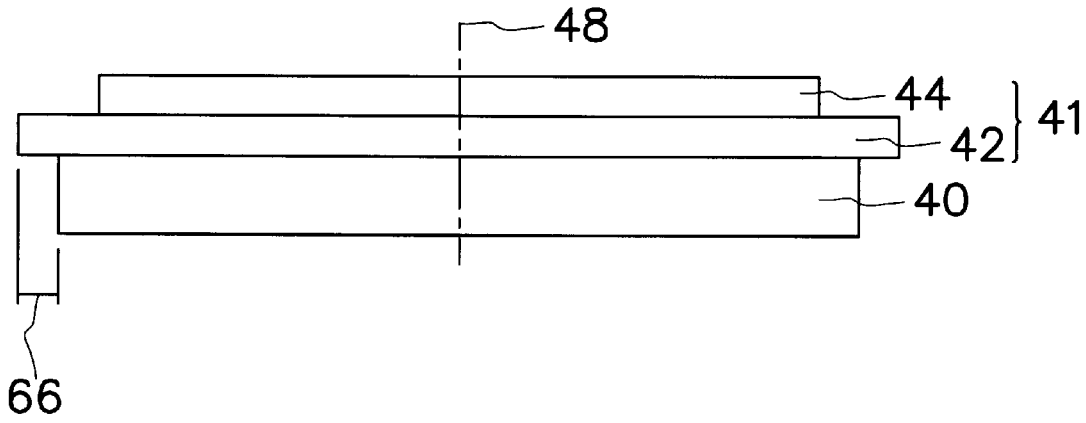
FIG. 6 shows another example of a composite polishing pad according to the invention.

FIG. 6 shows another example of a composite polishing pad provided by the invention. A turning table 40, a lower polishing pad 42 and an upper polishing pad 44 are overlaid concentrically with each other in sequence from bottom to top. The lower polishing pad 42 has a radius slightly larger than that of the turning table 40. For example, the radius difference 66 between the lower polishing pad 42 and the turning table 40 is between about 0.5–1.0 mm. In this manner, the design of the handler can be skipped while the renewal or changeover of the lower polishing pad 42 can be maintained as easy as ever. The upper polishing pad 44 is maintained with similar parameters as the previous embodiment. That is, the upper polishing pad 44 is designed with a radius such that the upper polishing pad 44 is between the covering ranges between the dresser 52 and the top ring 54.

As a conclusion, the invention provides a composite polishing pad with an upper and a lower polishing pads having certain dimensions to prevent the problems caused by a cutting step. Furthermore, with the design of a handler or the lower polishing pad slightly larger than the turning table, the lower polishing pad can be easily renewed or changed over.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A chemical mechanical polisher having a composite polishing pad, comprising:

a lower polishing pad with a first radius, concentrically superposed on a turning table, wherein the first radius is equal to a radius of the turning table; and an upper polishing pad with a second radius less than the first radius, concentrically disposed on the lower polishing pad, the second radius of the upper polishing pad is larger than a covering range of a top ring for holding a wafer to be polished, and smaller than a covering range of a dresser for initiating the composite polishing pad, wherein the covering range of the dresser is smaller than the diameter of the turning table so that no projecting rim is formed in the upper polishing pad.

2. The composite polishing pad according to claim 1, comprising further a handler at a periphery of the lower polishing pad.

3. The composite polishing pad according to claim 1, wherein the upper polishing pad is adhered onto the lower polishing pad by a glue.

4. The composite polishing pad according to claim 1, wherein the upper and the lower polishing pads are formed of polymer material.

5. A chemical mechanical polisher having a composite polishing pad, comprising:

a lower polishing pad with a first radius, disposed on a turning table concentrically thereto; and an upper polishing pad with a second radius less than the first radius, disposed on the lower polishing pad concentrically thereto; wherein the first radius of the lower polishing pad is larger than a radius of the turning table; and the second radius of the upper polishing pad is within a covering range of a dresser which is used to initiate the composite polishing pad so that no projecting rim is formed in the upper polishing pad, and larger than a covering range of a top ring which is use d to retain a wafer to be polished, and the covering range of the dresser is smaller than the turning table.

6. The polishing pad according to claim 5, upper polishing pad is adhered onto the lower polishing pad by a glue.

7. The polishing pad according to claim 5, wherein the upper and the lower polishing pads are formed of polymer material.

8. The polishing pad according to claim 5, wherein the radius of the lower polishing pad is about 0.5 mm to about 1.0 mm larger than the radius of the turning table.

9. A chemical mechanical polisher, comprising:

a turning table;

a lower polishing pad, concentrically disposed on the turning table;

an upper polishing pad, concentrically disposed on the lower polishing pad;

a slurry supplier, to supply onto the upper polishing pad for performing polishing;

a top ring, to hold a wafer to be polished, wherein the top ring generates a covering range against the upper polishing pad when the turning table is rotated; and a dresser, to initiate the upper and the lower polishing pads before performing polishing on the wafer, wherein the dresser generates a covering range against the upper polishing pad when the turning table is rotated;

wherein the upper polishing pad has a radius smaller than a radius of the lower polishing pad, and the radius of the upper polishing pad is ranged within the covering range of the dresser, and larger than the covering range of the top ring, wherein the covering range of the dresser is smaller than the turning table.

10. The chemical mechanical polisher according to claim 9, wherein the lower polishing pad has a radius the same as a radius of the turning table.

11. The chemical mechanical polisher according to claim 10, wherein the lower polishing pad further comprises a handler at a periphery thereof.

12. The chemical mechanical polisher according to claim 9, wherein the lower polishing pad has a radius slightly larger than a radius of the turning table, such that the lower polishing pad can be renewed easily.

13. The chemical mechanical polisher according to claim 12, wherein the radius of the lowering polishing pad is about 0.5 mm to about 1.0 mm larger than the radius of the turning table.

* * * * *